US011555350B2

(12) United States Patent
Fan et al.

(10) Patent No.: US 11,555,350 B2
(45) Date of Patent: Jan. 17, 2023

(54) SCREEN MOUNTING ASSEMBLY AND WINDOW HAVING THE SAME

(71) Applicant: ONWELL CURTAIN & SCREEN CO., LTD., Taichung (TW)

(72) Inventors: Chiu-Lan Fan, Taichung (TW); Chin-Yu Kuo, Taichung (TW)

(73) Assignee: ONWELL CURTAIN & SCREEN CO., LTD., Taichung (TW)

( * ) Notice: Subject to any disclaimer, the term of this patent is extended or adjusted under 35 U.S.C. 154(b) by 115 days.

(21) Appl. No.: 17/166,853

(22) Filed: Feb. 3, 2021

(65) Prior Publication Data

US 2021/0246721 A1 Aug. 12, 2021

(30) Foreign Application Priority Data

Feb. 7, 2020 (TW) ..... 109103824

(51) Int. Cl.
*E06B 9/54* (2006.01)
*E06B 9/44* (2006.01)
(Continued)

(52) U.S. Cl.
CPC ..... *E06B 9/54* (2013.01); *E06B 9/44* (2013.01); *E06B 9/52* (2013.01); *E06B 9/78* (2013.01);
(Continued)

(58) Field of Classification Search
CPC ..... E06B 9/44; E06B 2009/543; E06B 9/54; E06B 9/522; E06B 9/262;
(Continued)

(56) References Cited

U.S. PATENT DOCUMENTS 6,814,127 B2 * 11/2004 Tagtow ..... E06B 9/54 160/31
7,673,666 B2 * 3/2010 Fan ..... E06B 9/262 160/381
(Continued)

FOREIGN PATENT DOCUMENTS

CA 3070630 A1 * 1/2018 ..... E06B 9/42
CN 208310667 U 1/2019
(Continued)

OTHER PUBLICATIONS

Search Report appended to an Office Action, which was issued to Taiwanese counterpart application No. 109103824 by the TIPO dated Jul. 9, 2020 with an English translation thereof (2 pages).

*Primary Examiner* — Johnnie A. Shablack
*Assistant Examiner* — Matthew R. Shepherd
(74) *Attorney, Agent, or Firm* — Hamre, Schumann, Mueller & Larson, P.C.

(57) ABSTRACT

A window includes a window frame and a screen mounting assembly. The window frame is formed with two rail slots. The screen mounting assembly is adapted to be connected to a window screen and includes a roller unit, a sliding unit and an interconnecting unit. The roller unit includes a roller seat. The sliding unit is slidable along the rail slots and defines an engaging groove. The interconnecting unit is operable between a disengaging state where the interconnecting unit is connected to the roller seat, and an engaging state where the interconnecting unit is separated from the roller seat and inserted into the engaging groove so as to engage the sliding unit, such that movement of the sliding unit along the rail slots results in winding and unwinding of the window screen.

7 Claims, 11 Drawing Sheets

(51) Int. Cl.
*E06B 9/52* (2006.01)
*E06B 9/40* (2006.01)
*E06B 9/78* (2006.01)

(52) U.S. Cl.
CPC ... *E06B 2009/405* (2013.01); *E06B 2009/527* (2013.01); *E06B 2009/543* (2013.01)

(58) Field of Classification Search
CPC ..... E06B 2009/2625; E06B 2009/527; E06B 9/58; E06B 2009/528
See application file for complete search history.

(56) References Cited

U.S. PATENT DOCUMENTS 10,047,558 B2 * 8/2018 Hummel ..... E06B 3/80
2001/0042346 A1 * 11/2001 Brioschi ..... E06B 9/54
49/447
2006/0283564 A1 * 12/2006 Poppema ..... E06B 9/54
160/371
2007/0029053 A1 * 2/2007 Moriya ..... E06B 9/52
160/84.06
2008/0283204 A1 * 11/2008 Beck ..... E06B 9/42
160/369
2017/0211325 A1 * 7/2017 Riemelmoser ..... E06B 9/54
2019/0292846 A1 * 9/2019 Conrad ..... E06B 9/78
2020/0149346 A1 * 5/2020 Solomaniuck ..... E06B 9/58

FOREIGN PATENT DOCUMENTS

JP 2003343183 A * 12/2003 ..... E06B 9/54
JP 2009185457 A * 8/2009 ..... E06B 9/54
KR 2018032296 A * 3/2018 ..... E06B 9/54
KR 20180083503 A * 7/2018 ..... E06B 9/54
KR 102157349 B1 * 9/2020 ..... E06B 9/52
TW M406090 U 6/2011

* cited by examiner

SCREEN MOUNTING ASSEMBLY AND WINDOW HAVING THE SAME

CROSS-REFERENCE TO RELATED APPLICATION

This application claims priority to Taiwanese Invention Patent Application No. 109103824, filed on Feb. 7, 2020.

FIELD

The disclosure relates to a window, and more particularly to a window having a screen mounting assembly.

BACKGROUND

A conventional window 1 (see FIG. 1), which is disclosed in Taiwanese Patent No. M406090, includes a screen mounting assembly 20, a window frame 11 and a frame member 12. The screen mounting assembly 20 is coupled to the window frame 11, and includes a roller unit 210 connected to one end of a window screen 300 for the window screen 300 to be wound thereon. The frame member 12 is connected to an opposite end of the window screen 300 and is slidable on the window frame 11. Therefore, sliding movement of the frame member 12 will result in winding and unwinding of the window screen 30.

When the window screen 300 has to be replaced, the screen mounting assembly 20 must be uncoupled from the window frame 11 and the window screen 300 must be disconnected from the frame member 12. However, it is difficult for a customer or end user to disconnect the window screen 300 from the frame member 12. It is also not easy for the user to reconnect the window screen 300 to the frame member 12 after coupling the screen mounting assembly 20 back to the window frame 11.

SUMMARY

Therefore, an object of the disclosure is to provide a screen mounting assembly that can alleviate the drawbacks of the prior art.

According to the disclosure, the screen mounting assembly is adapted to be connected to a window screen and coupled to a window frame. The window frame defines a window opening therein, and is formed with two rail slots. The rail slots extend in a longitudinal direction, are disposed respectively at two ends of the window opening that are opposite in a transverse direction which is transverse to the longitudinal direction, and are in spatial communication with the window opening. The screen mounting assembly includes a roller unit, a sliding unit and an interconnecting unit. The roller unit includes a roller seat and a roller shaft. The roller seat is adapted to be connected removably to the window frame and to cooperate with the window frame to define a receiving space therebetween. The roller shaft is connected rotatably to the roller seat, is adapted to be disposed in the receiving space upon connection of the roller seat to the window frame, and is adapted to be connected to one end of the window screen for the window screen to be wound thereon. The sliding unit is adapted to be connected to the window frame and slidable along the rail slots of the window frame, and defines an engaging groove. The interconnecting unit is adapted to be connected to an opposite end of the window screen opposite to the one end of the window screen, and is operable between a disengaging state where the interconnecting unit is connected to the roller seat of the roller unit, and an engaging state where the interconnecting unit is separated from the roller seat and inserted into the engaging groove of the sliding unit so as to engage the sliding unit, such that movement of the sliding unit along the rail slots of the window frame results in winding and unwinding of the window screen.

Another object of the disclosure is to provide a window that includes the abovementioned screen mounting assembly.

According to the disclosure, the window includes a window frame and the abovementioned screen mounting assembly. The window frame defines a window opening therein and is formed with two rail slots. The rail slots extend in a longitudinal direction, and are connected respectively to two ends of the window opening that are opposite in a transverse direction which is transverse to the longitudinal direction. The screen mounting assembly is coupled to the window frame and is adapted to be connected to a window screen.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
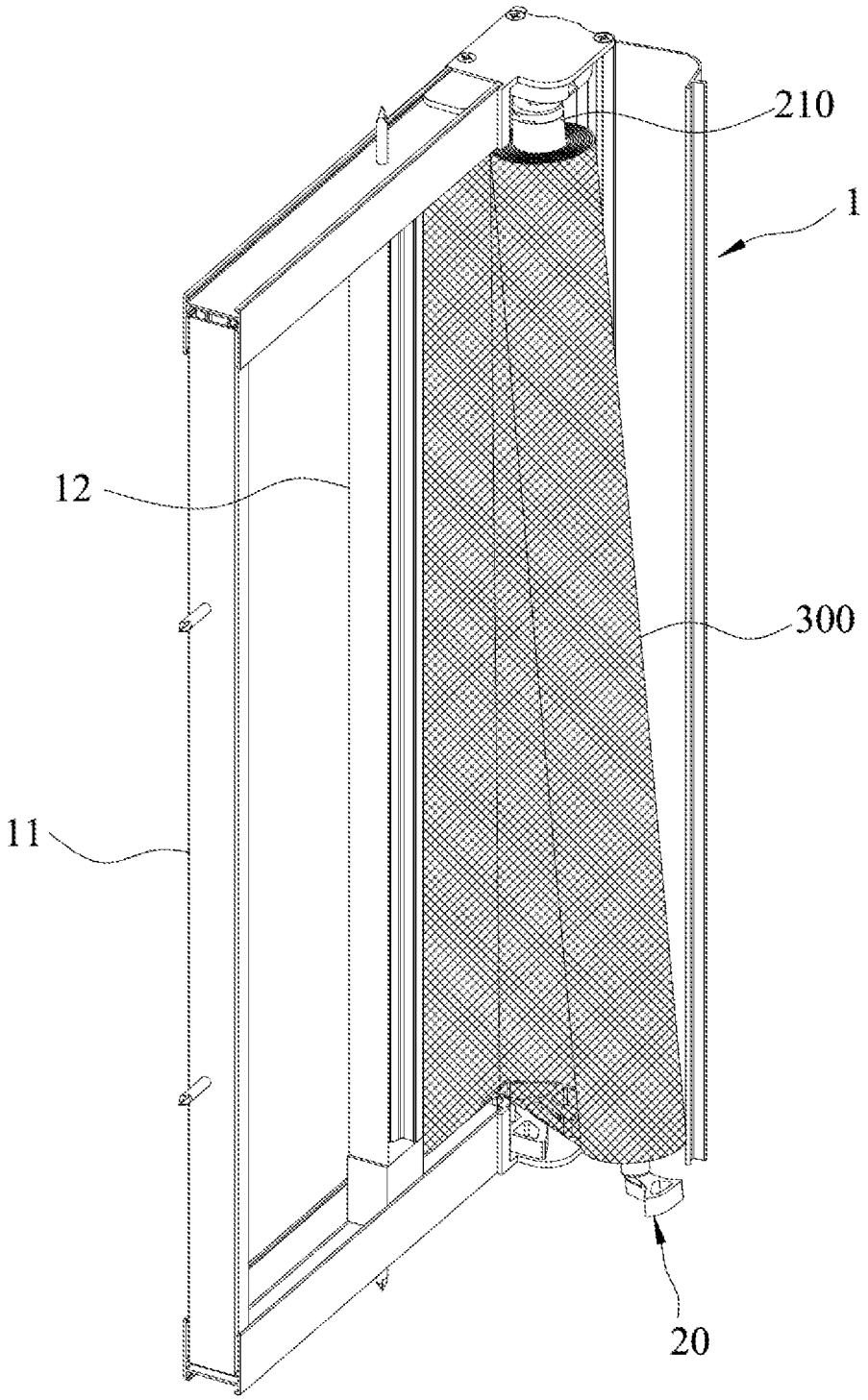
FIG.1 PRIOR ART
FIG. 1 is a perspective view of a conventional window with one end of a screen mounting assembly thereof being separated from a window frame.
Figure 2:
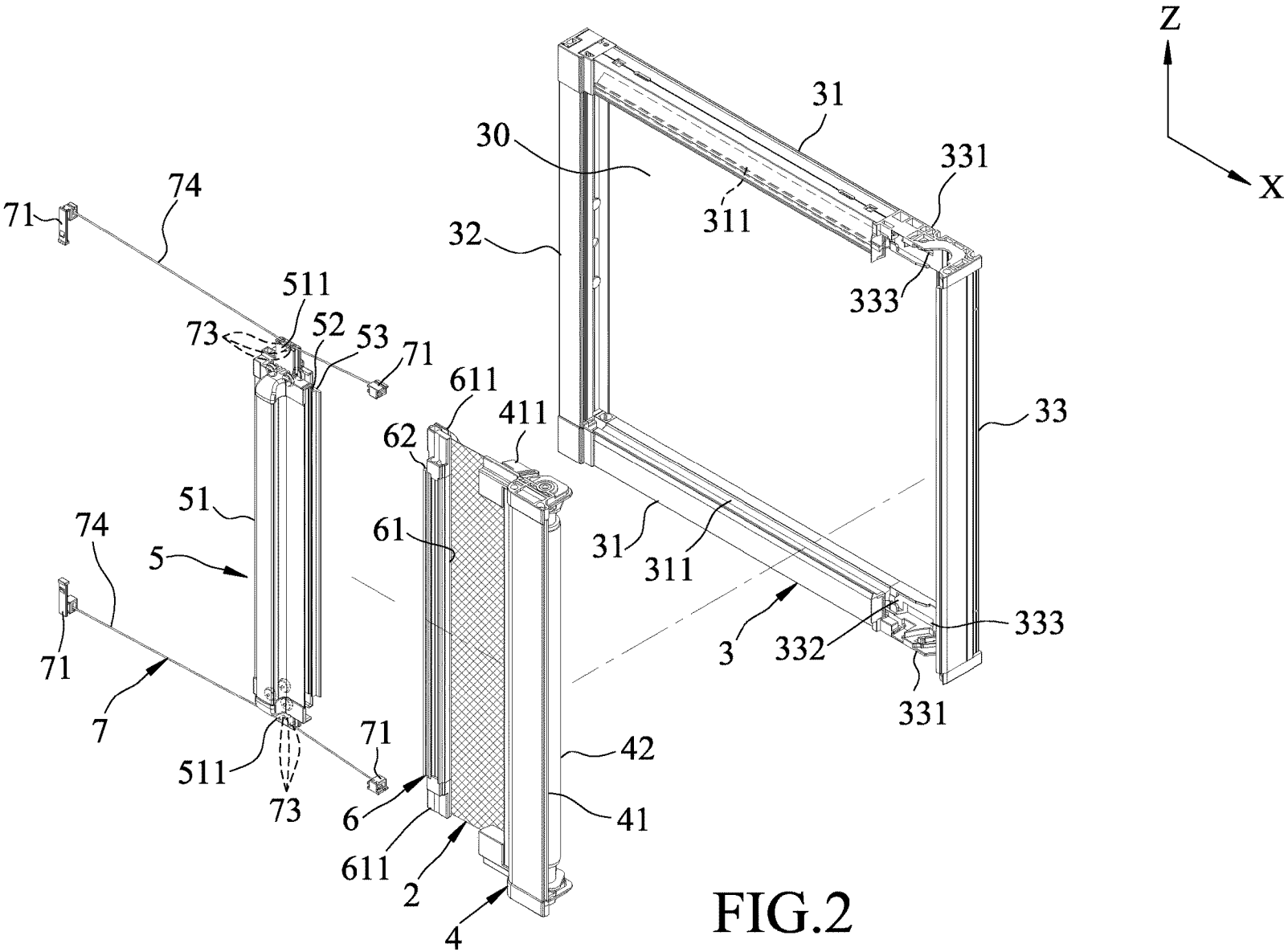
FIG. 2 is a partly exploded perspective view of an embodiment of a window according to the disclosure.
Figure 3:
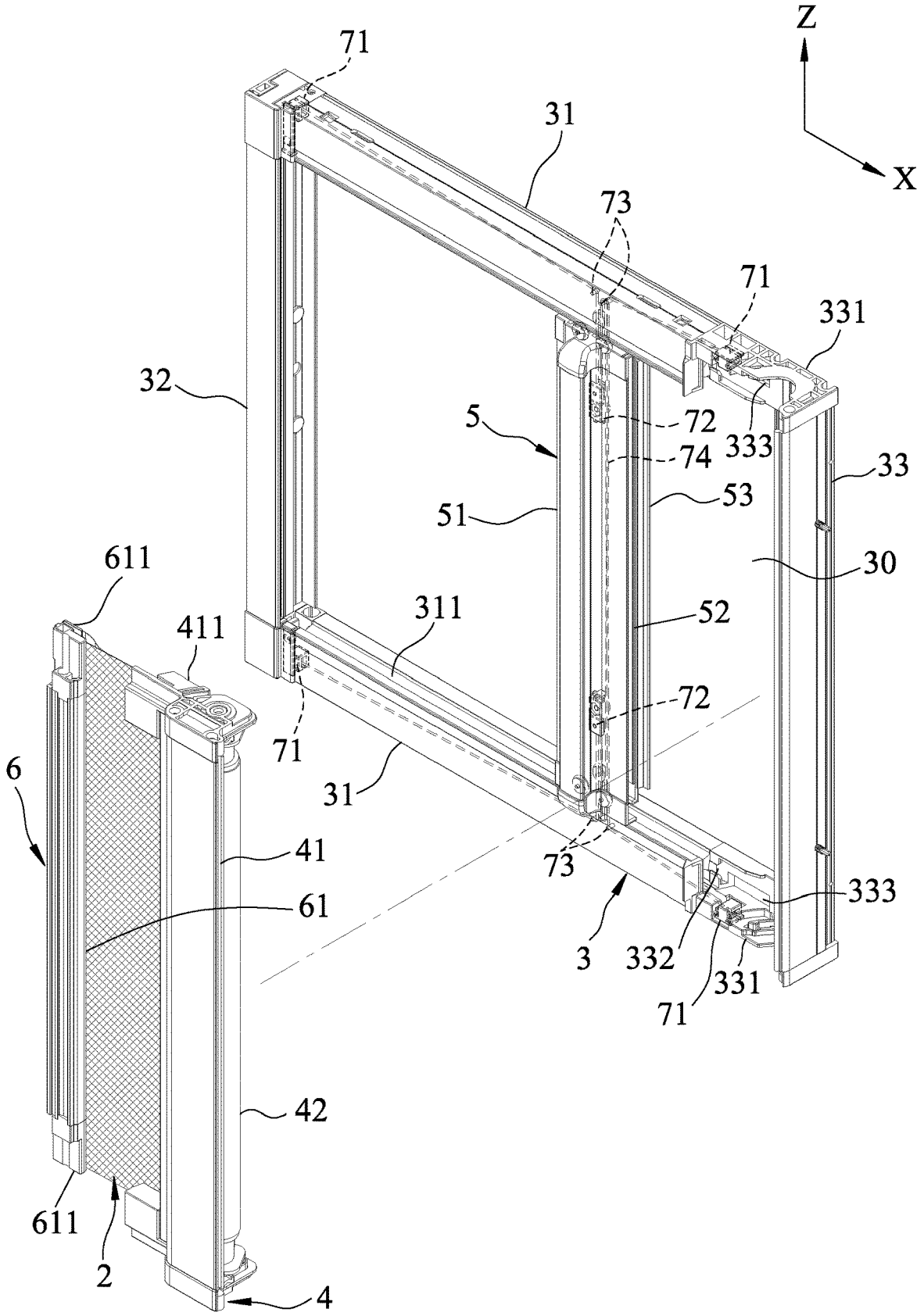
FIG. 3 is another partly exploded perspective view of the embodiment.
Figure 4:
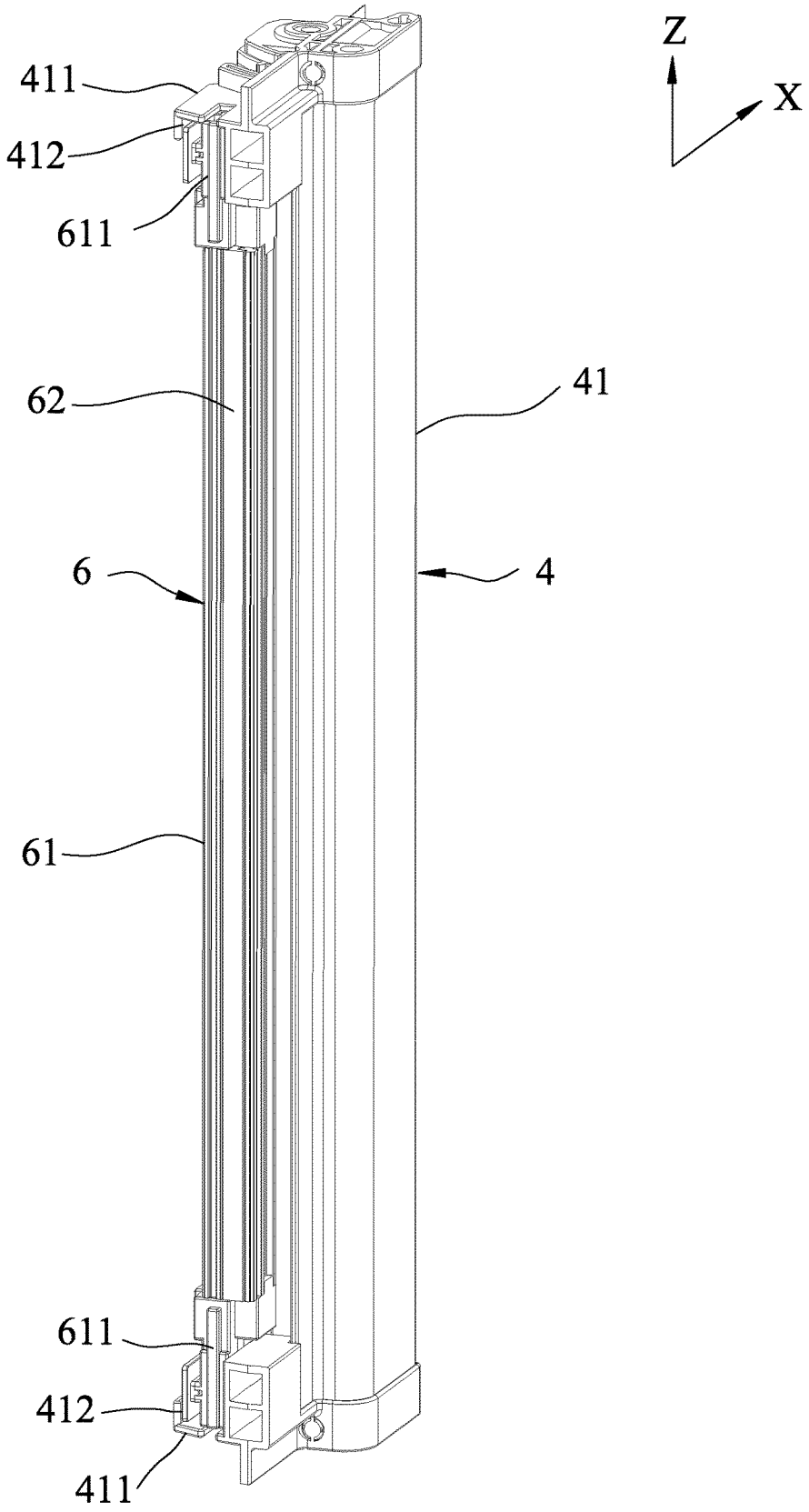
FIG. 4 is a perspective view illustrating a roller unit and an interconnecting unit of the embodiment.
Figure 5:
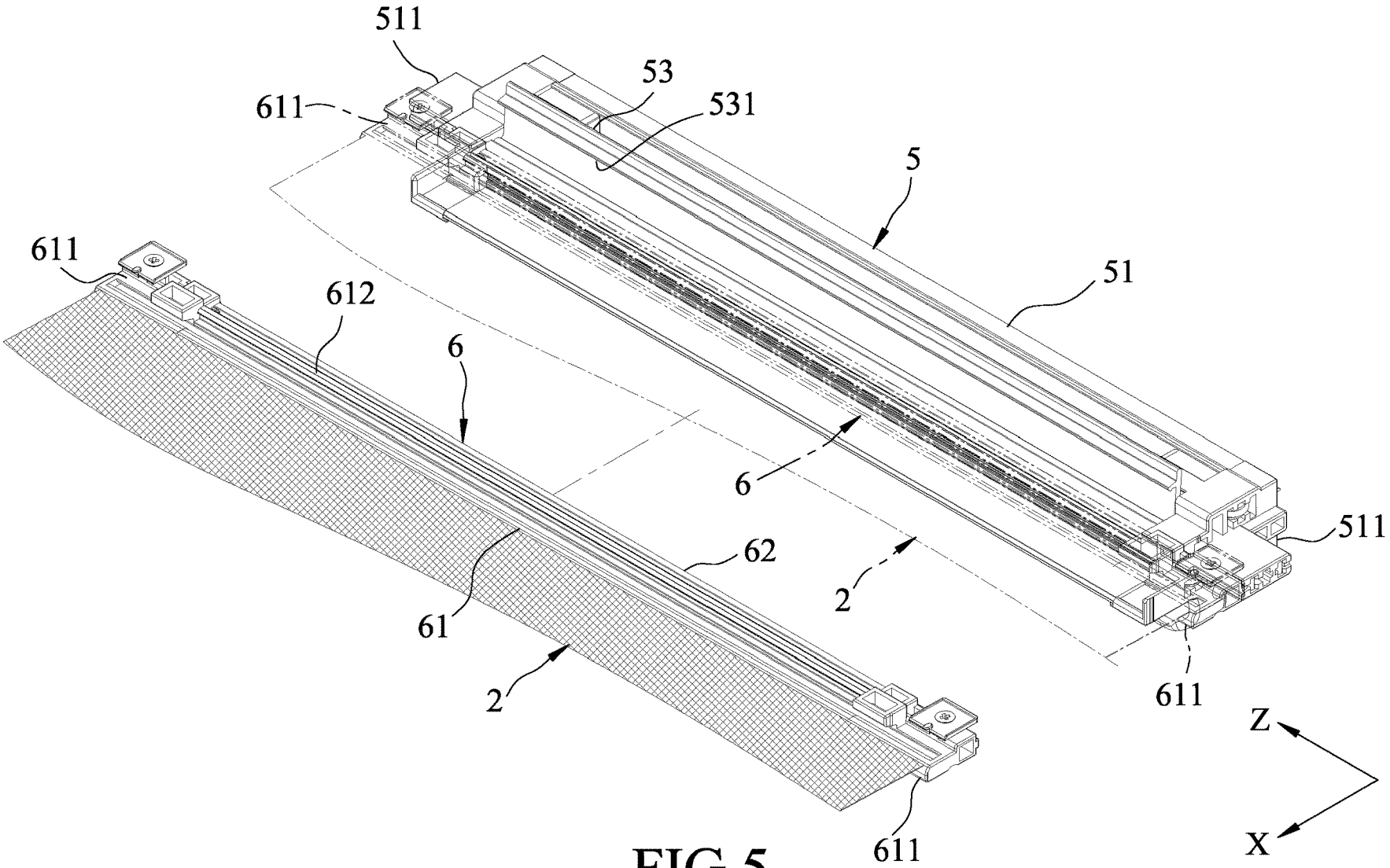
FIG. 5 is a fragmentary perspective view illustrating a process of connecting the interconnecting unit to a sliding unit.

Referring to FIGS. 2 to 5, an embodiment of a window according to the disclosure includes a window frame 3, a screen mounting assembly coupled to the window frame 3, and a constraining unit 7.

The window frame 3 defines a window opening 30 therein, and includes two rail frame members 31, a side frame member 32 and a roller frame member 33. The rail frame members 31 extend in a longitudinal direction (X), and are spaced apart from each other in a transverse direction (Z) transverse to the longitudinal direction (X). Each of the rail frame members 31 is formed with a rail slot 311 at an inner surface thereof. The rail slot 311 of each of the rail frame members 31 extends in the longitudinal direction (X), and has opposite ends in the longitudinal direction (X). The rail slots 311 of the rail frame members 31 are disposed respectively at two ends of the window opening 30 that are opposite in the transverse direction (Z), and the rail slots 311 are in spatial communication with the window opening 30. The side frame member 32 interconnects one of the ends (hereinafter also "first end") of one of the rail frame members 31 and one of the ends (hereinafter also "first end") of the other one of the rail frame members 31. The roller frame member 33 interconnects the other one of the ends (hereinafter also "second end") of the one of the rail frame members 31 and the other one of the ends (hereinafter also "second end") of the other one of the rail frame members 31, and cooperates with the rail frame members 31 and the side frame member 32 to define the window opening 30. Moreover, the roller frame member 33 has two coupling parts 331 formed respectively at two ends thereof that are opposite in the transverse direction (Z). Each of the coupling parts 331 has a rail surface 332 and a rail groove 333. The rail surface 332 is connected to a respective one of the rail slots 311. The rail groove 333 is formed in the rail surface 332.

Figure 7:
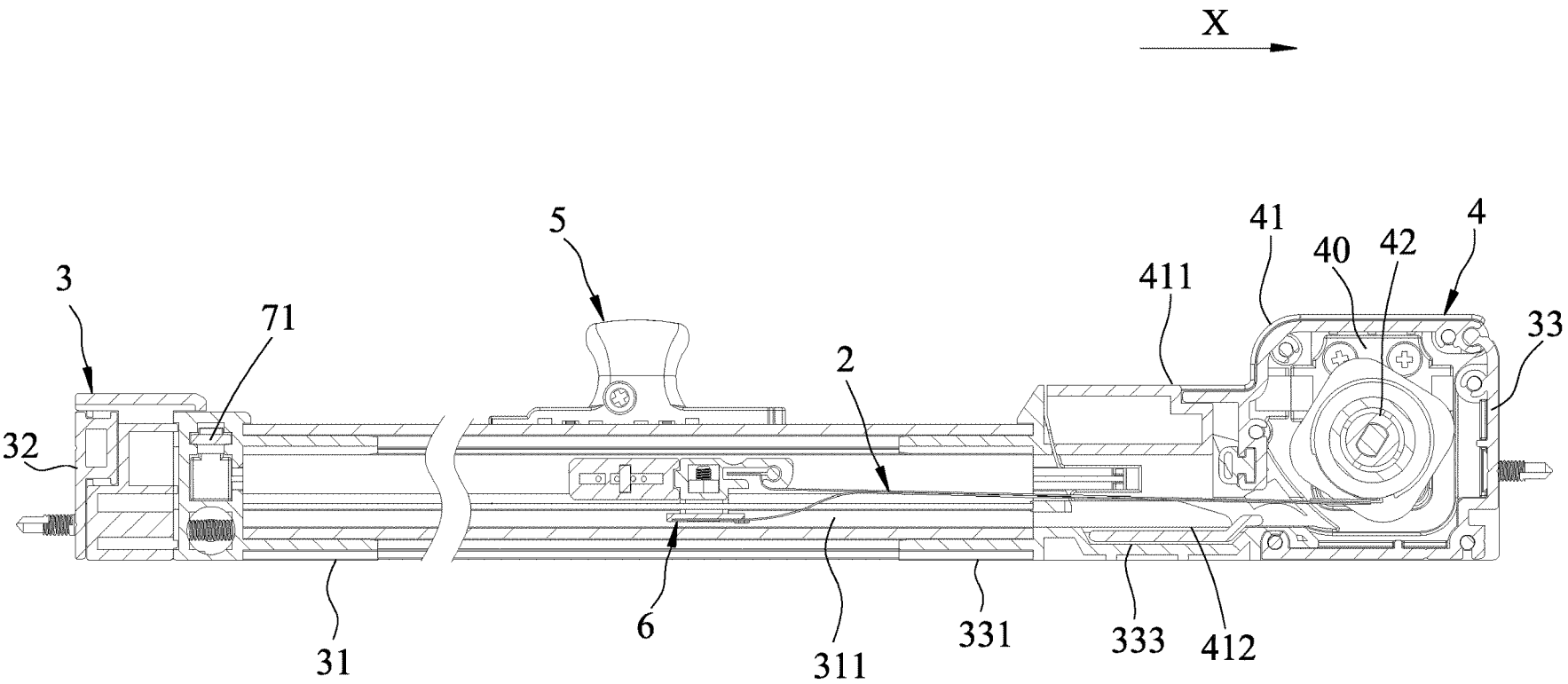
FIG. 7 is a fragmentary sectional view taken along line VII-VII in FIG. 6.

The screen mounting assembly includes a roller unit 4, a sliding unit 5 and an interconnecting unit 6. The roller unit 4 includes a roller seat 41 and a roller shaft 42. The roller seat 41 is connected removably to the roller frame member 33 of the window frame 3 and cooperates with the roller frame member 33 to define a receiving space 40 (see FIG. 7) therebetween. The roller seat 41 has two protruding parts 411 formed respectively at two ends thereof that are opposite in the transverse direction (Z) and extending in the longitudinal direction (X). Each of the protruding parts 411 engages removably the rail groove 333 of a respective one of the coupling parts 331 of the roller frame member 33, and has an abutting surface 412 extending in the longitudinal direction (X). The abutting surfaces 412 of the protruding parts 411 are spaced apart from each other in the transverse direction (Z). The roller shaft 42 is connected rotatably to the roller seat 41, is disposed in the receiving space 40 upon connection of the roller seat 41 to the window frame 3, and is adapted to be connected to one end of a window screen 2 for the window screen 2 to be wound thereon.

Figure 8:
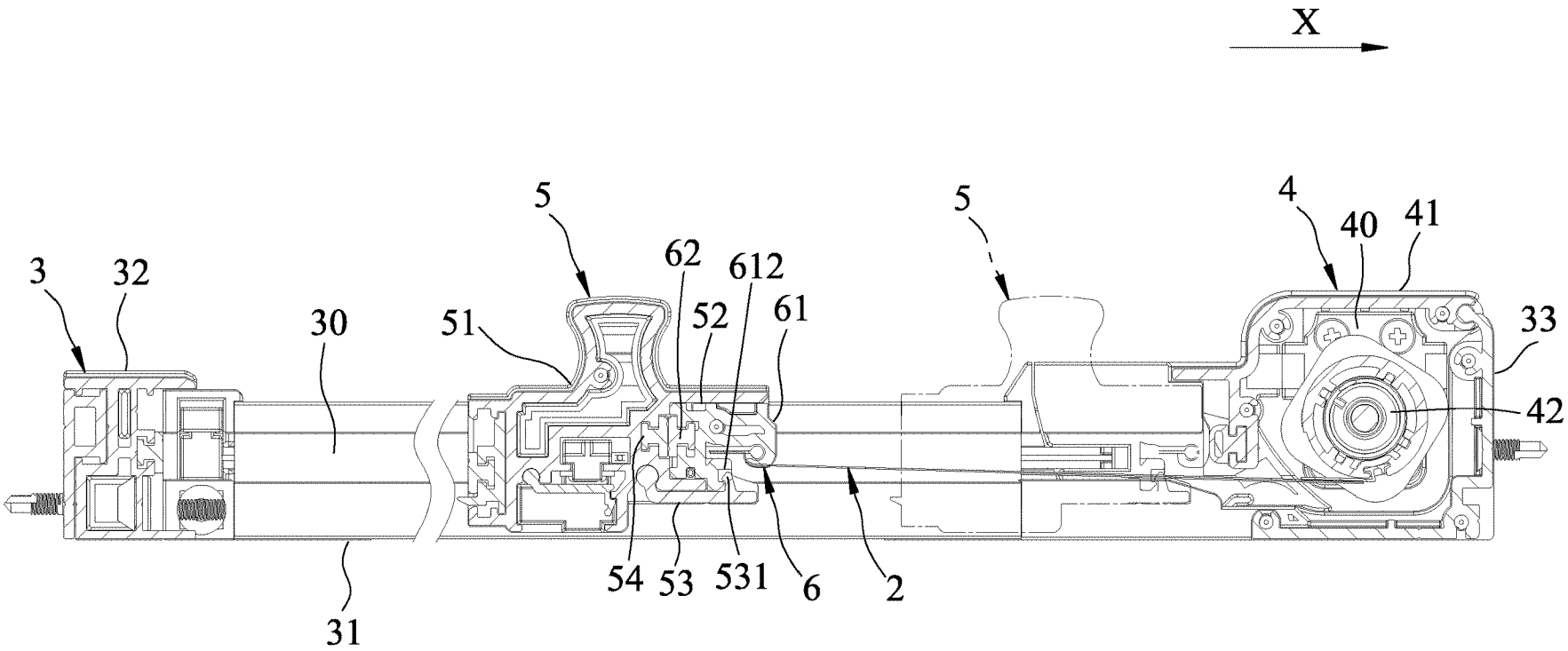
FIG. 8 is a fragmentary sectional view taken along line VIII-VIII in FIG. 6.

The sliding unit 5 includes a frame seat 51, a cover 53 and a magnetic component 54 (see FIG. 8). The frame seat 51 has two sliding parts 511 formed respectively at two ends thereof that are opposite in the transverse direction (Z) and engaging respectively and slidably the rail slots 311 of the rail frame members 31 of the window frame 3 so that the frame seat 51 is connected to the window frame 3 and is slidable along the rail slots 311. The cover 53 is connected to the frame seat 51 and pivotable relative to the frame seat 51 between an opened position (see FIG. 5) and a closed position (see FIGS. 2, 3 and 8). When at the closed position, the cover 53 cooperates with the frame seat 51 to define an engaging groove 52. Furthermore, the cover 53 has at least one engaging part 531 formed at an inner surface thereof and extending in the transverse direction (Z). The magnetic component 54 is mounted to the frame seat 51 and is disposed in the engaging groove 52 when the cover 53 is at the closed position.

The interconnecting unit 6 includes a linking member 61 and a magnetic member 62. The linking member 61 is adapted to be connected to an opposite end of the window screen 2 that is opposite to said one end of the window screen 2, extends in the transverse direction (Z), and has two sliding portions 611 and at least one linking portion 612. The sliding portions 611 are formed respectively at two ends of the linking member 61 that are opposite in the transverse direction (Z). The at least one linking portion 612 extends in the transverse direction (Z). The magnetic member 62 is connected to the linking member 61. In this embodiment, the at least one engaging part 531 includes one engaging part 531, and the at least one linking portion 612 includes one linking portion 612.

Figure 10:
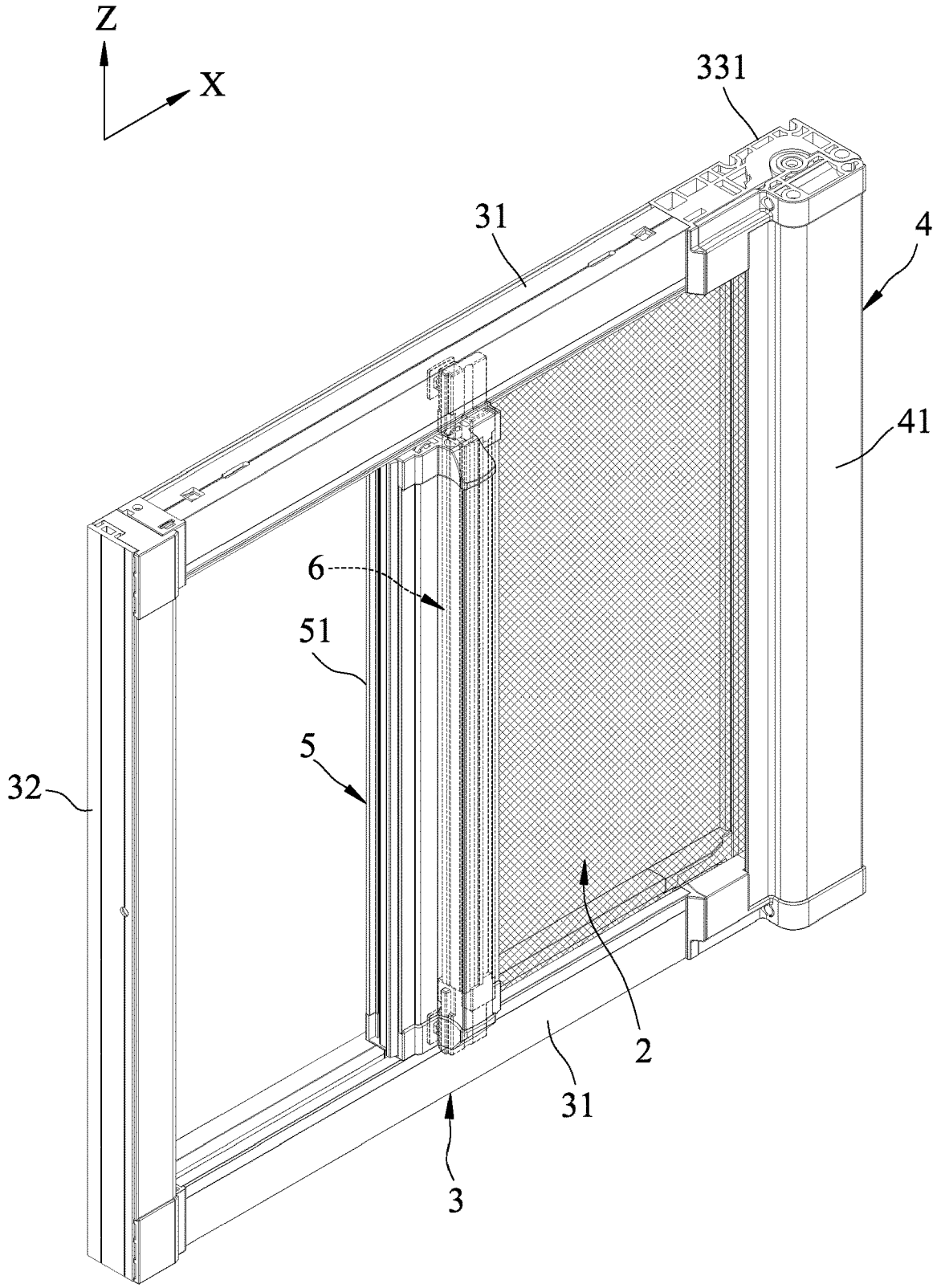
FIG. 10 is a perspective view of the embodiment, illustrating the interconnecting unit in an engaging state.
Figure 11:
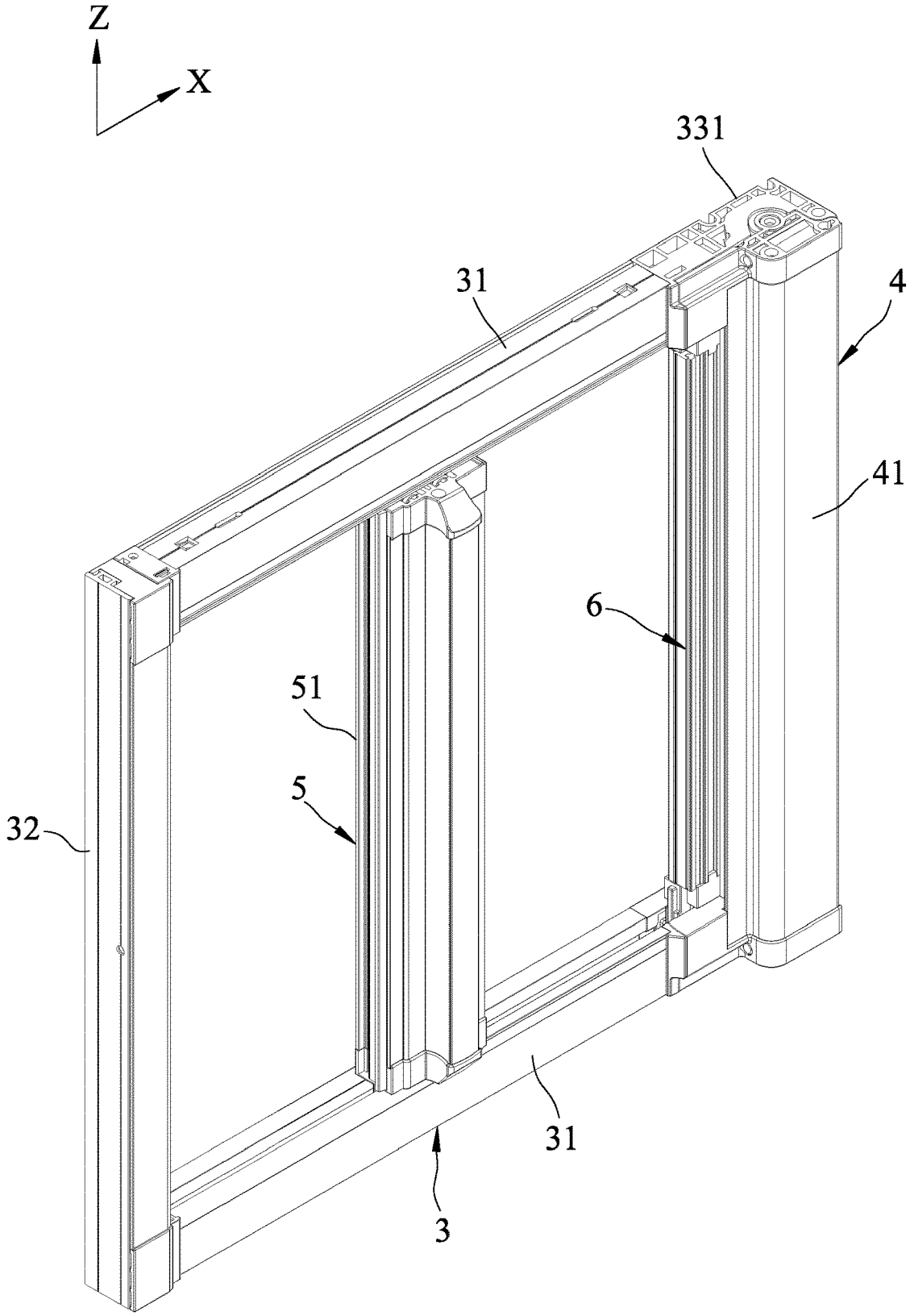
FIG. 11 is another perspective view of the embodiment, illustrating the interconnecting unit in a disengaging state.

The interconnecting unit 6 is operable between a disengaging state (see FIG. 11) and an engaging state (see FIG. 10). In the disengaging state, the interconnecting unit 6 is connected to the roller seat 41 of the roller unit 4. Specifically, the sliding portions 611 of the linking member 61 abut respectively and separably against the abutting surfaces 412 of the roller seat 41 of the roller unit 4 when the interconnecting unit 6 is in the disengaging state. In the engaging state, the interconnecting unit 6 is separated from the roller seat 41 and inserted into the engaging groove 52 of the sliding unit 5 so as to engage the sliding unit, such that movement of the sliding unit 5 along the rail slots 311 of the window frame 3 results in winding and unwinding of the window screen 2. One of the engaging part 531 of the cover 53 and the linking portion 612 of the linking member 61 is configured as a protrusion, and the other one of the engaging part 531 and the linking portion 612 is configured as a recess. In this embodiment, the engaging part 531 is configured as a protrusion, and the linking portion 612 is configured as a recess. The linking portion 612 engages the engaging part 531 when the interconnecting unit 6 is in the engaging state. When the interconnecting unit 6 is in the engaging state, the magnetic component 54 of the sliding unit 5 and the magnetic member 62 connect each other by way of magnetic attraction (as shown in FIG. 8), and the sliding portions 611 engage respectively and slidably the rail slots 311 and are adjacent respectively to the sliding parts 511 of the frame seat 51 of the sliding unit 5.

Figure 6:
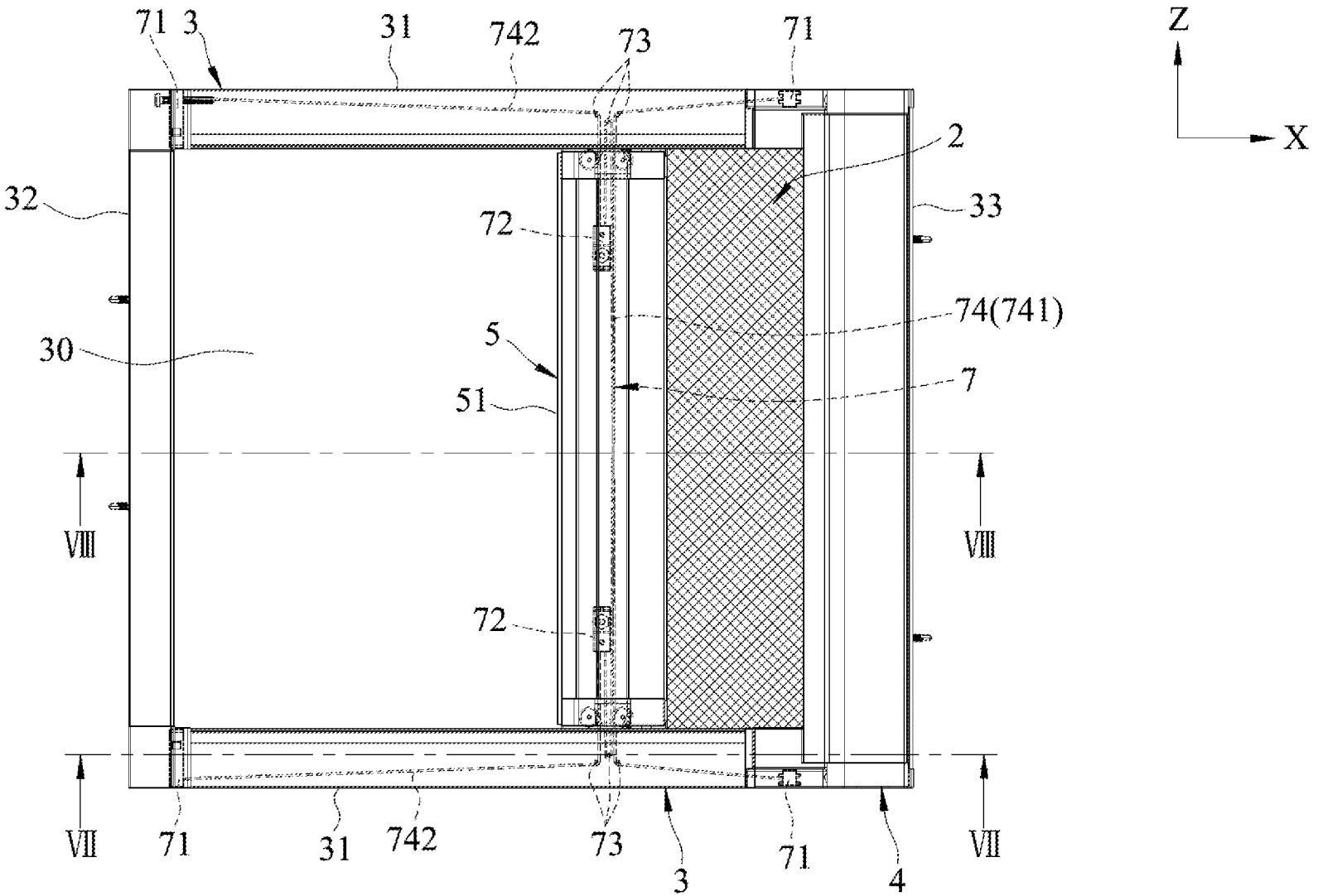
FIG. 6 is a front view of the embodiment.
Figure 9:
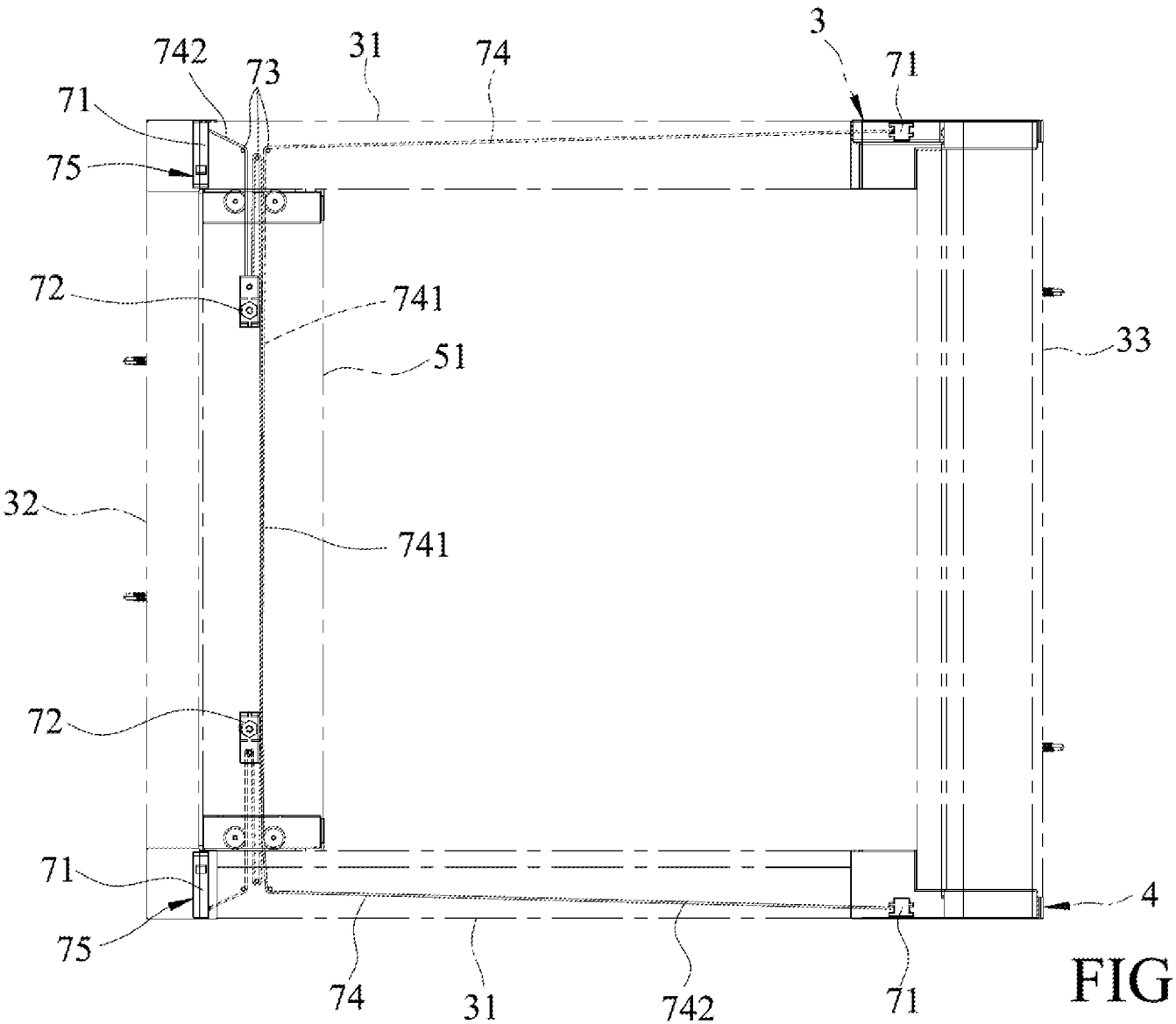
FIG. 9 is a schematic view illustrating two constraining sets of the embodiment being disposed on a window frame of the embodiment.

Referring further to FIGS. 6 and 9, the constraining unit 7 includes at least one rope 74, and two constraining sets 75. The at least one rope 74 extends through the sliding unit 5 and the rail frame members 31 of the window frame 3, and is operable for constraining free movement of the sliding unit 5 along the rail slots 311 of the window frame 3. In this embodiment, the at least one rope 74 includes two ropes 74, and each of the ropes 74 is connected to a respective one of the constraining sets 75. Each of the constraining sets 75 includes two end connecting members 71, an adjusting member 72 and a plurality of fixed members 73. For each of the constraining sets 75, the end connecting members 71 are disposed respectively on a respective one of the coupling parts 331 of the roller frame member 33 and the one of the ends (i.e., the first end) of a respective one of the rail frame members 31. In the embodiment depicted herein, the end connecting members 71 of one constraining set 75 are disposed at a diagonal. The adjusting member 72 of each of the constraining sets 75 is connected to the frame seat 51 of the sliding unit 5. For each of the constraining sets 75, the fixed members 73 are formed at a respective one of the sliding parts 511 of the frame seat 51. Each of the ropes 74 of the constraining unit 7 has a first rope section 741 and two second rope sections 742. The first rope section 741 extends through the sliding unit 5, is connected to the adjusting member 72 of the respective one of the constraining sets 75 and extends around the fixed members 73 of the constraining set 75. The second rope sections 742 of each of the ropes 74 extend respectively from opposite ends of the first rope section 741 of the rope 74, extend respectively into the rail frame members 31 and are connected respectively to the end connecting members 71 of the constraining set 75.

When the interconnecting unit 6 is in the disengaging state, when the protruding parts 411 of the roller seat 41 engage respectively the rail grooves 333 of the coupling parts 331 of the roller frame member 33, and when the sliding portions 611 of the interconnecting unit 6 abut respectively and separably against the abutting surfaces 412 of the roller seat 41, the sliding portions 611 can be moved to respectively and smoothly engage the rail slots 311 when the interconnecting unit 6 is moved from the disengaging state to the engaging state.

In practice, when the interconnecting unit 6 is in the engaging state, a user can operate the window screen 2, by moving the sliding unit 5, to cover a desired portion of the window opening 30 (see FIG. 10) and to position the window screen 2 at a desired position by means of the constraining unit 7.

In summary, since the sliding unit 5 is operable to engage the interconnecting unit 6, and to disengage the interconnecting unit 6 to allow separation of the interconnecting unit 6 from the sliding unit 5, when the window screen 2 has to be replaced, the window screen 2 can be easily removed from the window frame 3 together with the roller unit 4 and the interconnecting unit 6 without removal of the sliding unit 5 from the window frame 3. That is to say, the window is configured to provide a relatively easy way for a customer to replace the window screen 2 on his/her own, and the purpose of the disclosure is certainly fulfilled.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A screen mounting assembly adapted to be connected to a window screen and coupled to a window frame, the window frame defining a window opening therein and the window frame being formed with two rail slots that extend in a longitudinal direction, that are disposed respectively at two ends of the window opening which are opposite in a transverse direction, and that are in spatial communication with the window opening, the transverse direction being transverse to the longitudinal direction, said screen mounting assembly comprising:

a roller unit including a roller seat that is adapted to be connected removably to the window frame and to cooperate with the window frame to define a receiving space therebetween when connected, and a roller shaft that is connected rotatably to said roller seat, that is adapted to be disposed in the receiving space when said roller seat is connected to the window frame, and that is adapted to be connected to one end of the window screen for the window screen to be wound thereon;

a sliding unit adapted to be connected to the window frame and slidable along the rail slots of the window frame when connected to the window frame, and defining an engaging groove; and an interconnecting unit adapted to be connected to an opposite end of the window screen opposite to the one end of the window screen, and, when said interconnecting unit is connected to the window screen, the interconnecting unit is operable between a disengaging state where said interconnecting unit is connected to said roller seat of said roller unit, and an engaging state where said interconnecting unit is separated from said roller seat and inserted into said engaging groove of said sliding unit so as to engage with said sliding unit, such that movement of said sliding unit along the rail slots of the window frame results in winding or unwinding of the window screen;

wherein said sliding unit includes a frame seat adapted to be connected to the window frame and, when the sliding unit is connected to the window frame, the sliding unit is slidable along the rail slots of the window frame, and a cover connected to said frame seat and pivotable relative to said frame seat between an opened position and a closed position, said cover cooperating with said frame seat to define said engaging groove when at the closed position;

wherein said cover has at least one engaging part formed at an inner surface thereof:

wherein said interconnecting unit has at least one linking portion that engages said at least one engaging part of said cover when said interconnecting unit is in the engaging state; and wherein, of said at least one engaging part of said cover and said at least one linking portion of said interconnecting unit, one is configured as a protrusion and the other is configured as a recess.

2. The screen mounting assembly as claimed in claim 1, wherein:

said roller seat of said roller unit has two abutting surfaces spaced apart from each other in the transverse direction and extending in the longitudinal direction; and said interconnecting unit abuts separably against said abutting surfaces when said interconnecting unit is in the disengaging state.

3. The screen mounting assembly as claimed in claim 2, wherein:

said sliding unit has two sliding parts formed respectively at two ends thereof that are opposite in the transverse direction, and adapted for engaging respectively and slidably the rail slots of the window frame;

said interconnecting unit has two sliding portions formed respectively at two ends thereof that are opposite in the transverse direction;

when said interconnecting unit is in the engaging state, said sliding portions engage respectively and slidably the rail slots and are adjacent respectively to said sliding parts of said sliding unit; and when said interconnecting unit is in the disengaging state, said sliding portions abut respectively and separably against said abutting surfaces of said roller seat of said roller unit.

4. The screen mounting assembly as claimed in claim 1, wherein:

said sliding unit further includes a magnetic component mounted to said frame seat, and disposed in said engaging groove when said cover is at the closed position;

said interconnecting unit includes a linking member formed with said at least one linking portion, and a magnetic member connected to said linking member; and said magnetic component and said magnetic member connect each other by way of magnetic attraction when said interconnecting unit is in the engaging state.

5. A window comprising:

a window frame defining a window opening therein, and being formed with two rail slots that extend in a longitudinal direction, that are disposed respectively at two ends of said window opening which are opposite in a transverse direction, and that are in spatial communication with said window opening, the transverse direction being transverse to the longitudinal direction; and the screen mounting assembly of claim 1 coupled to said window frame;

wherein said window frame includes two rail frame members spaced apart from each other in the transverse direction and extending in the longitudinal direction, each of said rail frame members being formed with a respective one of said rail slots at an inner surface thereof, and having opposite ends in the longitudinal direction, a side frame member interconnecting one of said ends of one of said rail frame members and one of said ends of the other one of said rail frame members, and a roller frame member interconnecting the other one of said ends of the one of said rail frame members and the other one of said ends of the other one of said rail frame members, and cooperating with said rail frame members and said side frame member to define said window opening;

wherein said roller unit of said screen mounting assembly is connected removably to said roller frame member and cooperates with said roller frame member to define said receiving space therebetween;

wherein said roller frame member of said window frame has two coupling parts formed respectively at two ends thereof that are opposite in the transverse direction;

wherein each of said coupling parts has a rail surface connected to a respective one of said rail slots of said rail frame members, and a rail groove formed in said rail surface;

wherein said roller seat of said roller unit of said screen mounting assembly has two protruding parts formed respectively at two ends thereof that are opposite in the transverse direction and extending in the longitudinal direction;

wherein each of said protruding parts engages removably said rail groove of a respective one of said coupling parts of said roller frame member, and has an abutting surface extending in the longitudinal direction; and wherein said interconnecting unit of said screen mounting assembly abuts separably against said abutting surfaces when said interconnecting unit is in the disengaging state.

6. The window as claimed in claim 5, further comprising a constraining unit that includes at least one rope which extends through said sliding unit and said rail frame members of said window frame, said at least one rope being operable for constraining free movement of said sliding unit along said rail slots.

7. The window as claimed in claim 6, wherein:

said constraining unit further includes two constraining sets, each of said constraining sets including two end connecting members that are disposed respectively on a respective one of said coupling parts of said roller frame member and the one of said ends of a respective one of said rail frame members, an adjusting member that is connected to said sliding unit of said screen mounting assembly, and a plurality of fixed members that are formed at said sliding unit; and said at least one rope includes two ropes, each being connected to a respective one of said constraining sets and having a first rope section that extends through said sliding unit, that is connected to said adjusting member of the respective one of said constraining sets, and that extends around said fixed members of the respective one of said constraining sets, and two second rope sections that extend respectively from opposite ends of said first rope section, that extend respectively into said rail frame members and that are connected respectively to said end connecting members of the respective one of said constraining sets.

* * * * *